US008008863B2

(12) United States Patent
Chiang et al.

(10) Patent No.: US 8,008,863 B2
(45) Date of Patent: Aug. 30, 2011

(54) DRIVING SYSTEM AND METHOD FOR COLOR SEQUENTIAL LIQUID CRYSTAL DISPLAY (LCD)

(75) Inventors: Min-feng Chiang, Hsin-Chu (TW); Hsueh-ying Huang, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 1002 days.

(21) Appl. No.: 11/865,232

(22) Filed: Oct. 1, 2007

(65) Prior Publication Data

US 2008/0088566 A1 Apr. 17, 2008

(30) Foreign Application Priority Data

Oct. 14, 2006 (TW) ..... 95137859 A

(51) Int. Cl.
*G09G 3/36* (2006.01)

(52) U.S. Cl. ..... 315/102; 345/211; 345/213; 349/61

(58) Field of Classification Search ..... 345/87, 345/89, 98, 100, 204, 102, 211–213, 690
See application file for complete search history.

(56) References Cited

U.S. PATENT DOCUMENTS

| | | | | |
|---|---|---|---|---|
| 4,893,060 | A | 1/1990 | Ohba et al. | |
| 5,049,865 | A * | 9/1991 | Nakamura et al. | 345/60 |
| 5,233,338 | A | 8/1993 | Surguy | |
| 5,754,153 | A * | 5/1998 | Mizutome et al. | 345/97 |
| 5,903,251 | A | 5/1999 | Mori et al. | |
| 6,037,920 | A * | 3/2000 | Mizutome et al. | 345/87 |
| 6,313,821 | B1 | 11/2001 | Mizuno | |
| 6,573,882 | B1 | 6/2003 | Takabayashi | |
| 6,731,265 | B1 * | 5/2004 | Kokuhata et al. | 345/101 |
| 6,762,743 | B2 | 7/2004 | Yoshihara et al. | |
| 6,836,265 | B1 | 12/2004 | Lee et al. | |
| 2005/0151717 | A1 * | 7/2005 | Seo | 345/102 |

FOREIGN PATENT DOCUMENTS

| | | | |
|---|---|---|---|
| JP | 1996110514 | A | 4/1996 |
| JP | 1998268267 | A | 10/1998 |
| JP | 11143389 | | 5/1999 |

* cited by examiner

*Primary Examiner* — Quan-Zhen Wang
*Assistant Examiner* — Jennifer Nguyen
(74) *Attorney, Agent, or Firm* — Kirton & McConkie; Evan R. Witt

(57) ABSTRACT

A driving system and method for color sequential liquid crystal display (LCD) are described. The driving system includes a sensor, scanning modules, switching modules and a control unit. The control unit receives the sensing signal from the sensor and controls the first switching module based on the sensing signal for switching the scanning module to select one of the scanning modes in response to the environment temperature. The control unit adjusts the scanning direction of the liquid crystal display according to the switched scanning mode. The control unit controls the switching module based on the driving mode corresponding to the sensing signal. Further, the switching module switches the gamma voltage-setting module for selecting one of the voltage-setting values in response to the sensing signal and driving the liquid crystal display.

23 Claims, 9 Drawing Sheets

DRIVING SYSTEM AND METHOD FOR COLOR SEQUENTIAL LIQUID CRYSTAL DISPLAY (LCD)

FIELD OF THE INVENTION

The present invention generally relates to a driving system and method for a display, and more particularly to a driving system and method for a color sequential liquid crystal display.

BACKGROUND OF THE INVENTION

Conventionally, a white-light backlight is employed in a liquid crystal display (LCD) composed of thin film transistors (TFT) to be served as a light source. Further, a color filter having three primary colors, i.e. red, green, and blue colors, is used in the TFT-LCD to display color images. However, a color sequential liquid crystal display has no color filter but uses a light source having red, green, and blue colors for sequentially illuminating during a frame period. Since visual persistence to the light source occurs while people focus on the light source, the LCD is capable of displaying the image colors by mixing the three primary colors.

Currently, in color sequential LCDs, there is only one kind of driving mode, a scanning mode with the same scanning direction and gamma control voltage of the scanning mode for the LCD panel. An LCD panel may display the image colors by the former driving method under room temperature; however, since the response of liquid crystal becomes slow at a low temperature, color-mixing occurs at a low temperature condition in comparison with room temperature condition. Thus, the brightness at the top and the bottom regions of an LCD panel is not uniform.

Generally, the response speed of liquid crystal molecules depends on the environment temperature, and thus an LCD panel is subject to suffer a problem of the uneven brightness at room temperature. Particularly, the issue of uneven brightness and color-mixing in the panel are more critical and severe at a low temperature, and therefore the reliability of the LCD panel at various temperatures is downgraded, thereby placing restrictions on the applications of LCD panels. Therefore, a method for solving the above-mentioned problem of display quality is an important and urgent issue for manufactures of color sequential LCDs.

Consequently, there is a need to develop a novel color sequential LCD to improve the brightness performance and color-mixing of the LCD panel when the LCD panel is operated at either room temperature or low temperature.

SUMMARY OF THE INVENTION

One object of the present invention is to provide a driving system and method for a color sequential LCD to improve color uniformity at the top and bottom regions of an LCD panel at a low temperature to increase the LCD display quality.

Another object of the present invention is to provide a driving system and method for a color sequential LCD to improve color-mixing of the image when the LCD is operated at a low temperature.

According to the above objects, the present invention sets forth a driving system and method thereof. The driving system includes a sensor, a scanning module, a first switching module and a control unit. The LCD panel has a plurality of gate lines and data lines. A voltage signal is inputted to the gate lines and data lines to drive the LCD panel so that the LCD panel displays image colors according to the image data. The sensor is electrically coupled to the control unit and senses an environment temperature of the liquid crystal display (LCD) panel for generating a sensing signal according to the environment temperature.

The scanning module has a plurality of scanning modes wherein one of the scanning modes corresponds to the sensing signal. The sensing signal indicates the temperature of the LCD panel. The first switching module electrically coupled to the scanning module and the control unit switches the scanning module for selecting one of the scanning modes in response to the sensing signal. The control unit electrically coupled to the sensor, the first switching module, and the LCD receives the sensing signal from the sensor. The control unit then controls the first switching module based on the sensing signal for switching the scanning module to one of the scanning modes in response to the environment temperature. The control unit adjusts the scanning direction of the gate driver of the liquid crystal display according to the scanning mode. In one embodiment, the scanning module sets the scanning mode to be the same status of scanning direction for controlling the gate driver of the liquid crystal display to be the same scanning direction. In another embodiment, the scanning module sets the scanning mode to be a different status of scanning directions for controlling the gate driver of the liquid crystal display to be the different scanning directions.

In another embodiment, the driving system further includes a backlight-adjusting unit electrically coupled to the control unit. The backlight-adjusting unit generates a backlight-timing control value for adjusting the backlight which illuminates the liquid crystal display. The backlight-timing control value can be the starting time, illumination duration, end time, and/or illumination intensity for controlling the backlight.

In operation, the driving method includes:

The sensor senses variation of environment temperature for a liquid crystal display and generates a sensing signal corresponding to a particular temperature based on the environment temperature. The sensing signal corresponds to a scanning mode. In one case, the scanning mode can be a status of scanning direction for controlling the gate driver of the liquid crystal display to be the same scanning direction. In another case, the scanning mode may be a status of different scanning directions for controlling the gate driver of the liquid crystal display to be the different scanning directions.

The first switching module switches the scanning mode for selecting one of the scanning modes in response to the sensing signal.

The control unit receives the sensing signal from the sensor.

The control unit controls the first switching module based on the sensing signal for switching the scanning module to select one of the scanning modes of the scanning module in response to the environment temperature.

The control unit adjusts the scanning direction of the gate driver of the liquid crystal display according to the scanning mode.

The present invention provides a driving system and method for color sequential LCDs to improve color uniformity and color-mixing when the LCD is operated at a relative low temperature.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
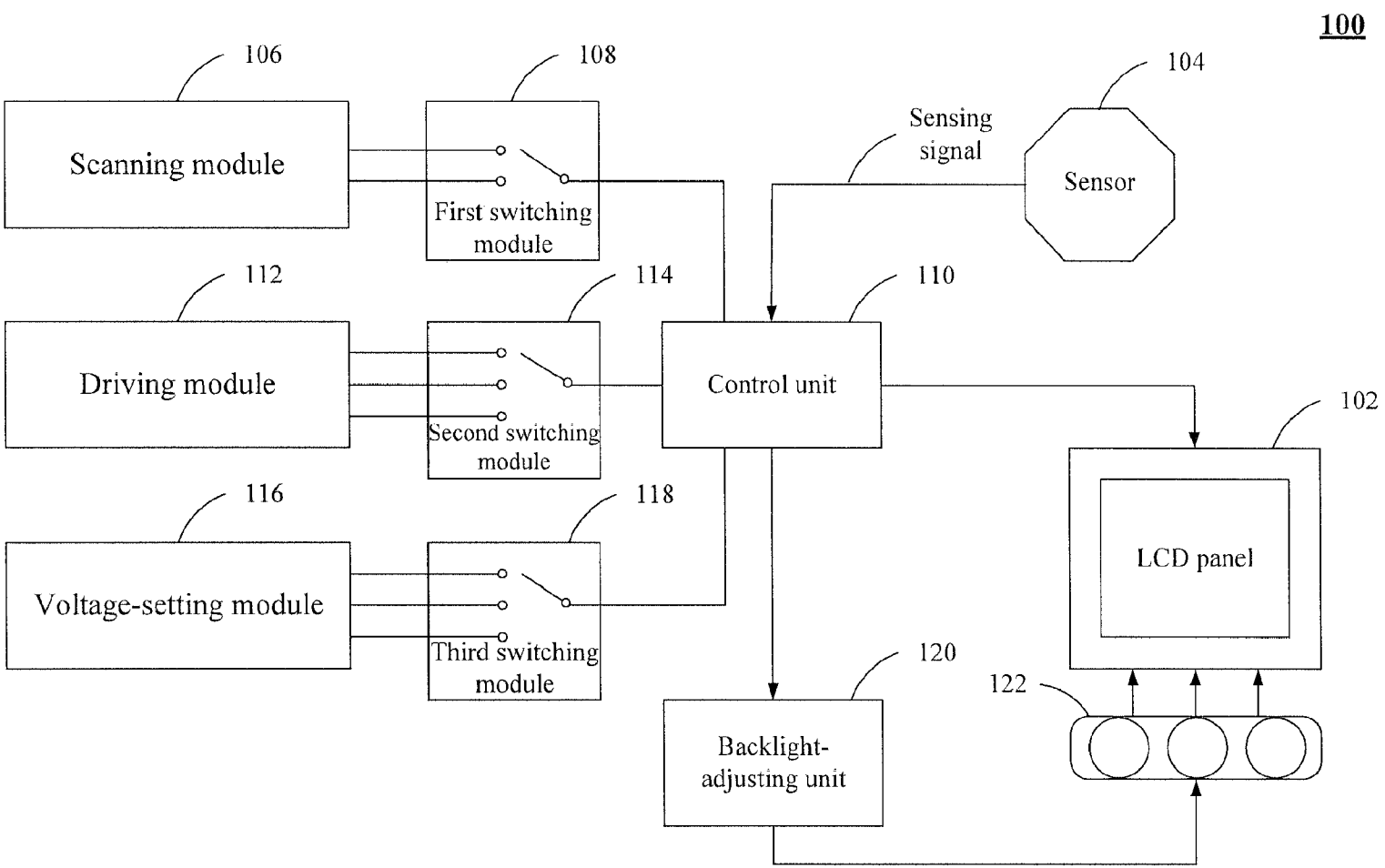
FIG. 1 is a schematic diagram of a driving system of an LCD according to one embodiment of the present invention.

FIG. 1 depicts a schematic diagram of a driving system of an LCD according to one embodiment of the present invention. The driving system includes a sensor 104, a scanning module 106, a first switching module 108 and a control unit 110. The LCD panel 102 has a plurality of gate lines and data lines. A voltage signal is inputted to the gate lines and data lines to drive the LCD panel so that LCD panel 102 displays image colors according to the image data. The sensor 104 is electrically coupled to the control unit 110 and senses an environment temperature of the liquid crystal display (LCD) panel 102 for generating a sensing signal according to the environment temperature.

The scanning module 106 has a plurality of scanning modes wherein one of the scanning modes corresponds to the sensing signal. The sensing signal indicates the temperature of LCD panel 102. The first switching module 108 electrically coupled to the scanning module and the control unit 110 switches the scanning module 106 for selecting one of the scanning modes in response to the sensing signal. The control unit 110 electrically coupled to the sensor 104, the first switching module 108 and LCD 102 receives the sensing signal from the sensor 104. The control unit 110 then controls the first switching module 108 based on the sensing signal for switching the scanning module 106 to one of the scanning modes in response to the environment temperature. The control unit 110 adjusts the scanning direction of the gate driver of the liquid crystal display according to the scanning mode. In one embodiment, the scanning module 106 sets the scanning mode to be the same status of scanning direction for controlling the gate driver of the liquid crystal display to be the same scanning direction. In another embodiment, the scanning module 106 sets the scanning mode to be a different status of scanning directions for controlling the gate driver of the liquid crystal display to be the different scanning directions.

In one embodiment, the driving system 100 further includes a backlight-adjusting unit 120 electrically coupled to the control unit 110. The backlight-adjusting unit 120 generates a backlight-timing control value for adjusting the backlight 122 which illuminates the liquid crystal display 102. The backlight-timing control value can be the starting time, illumination duration, end time, and illumination intensity for controlling the backlight 122.

Figure 2:
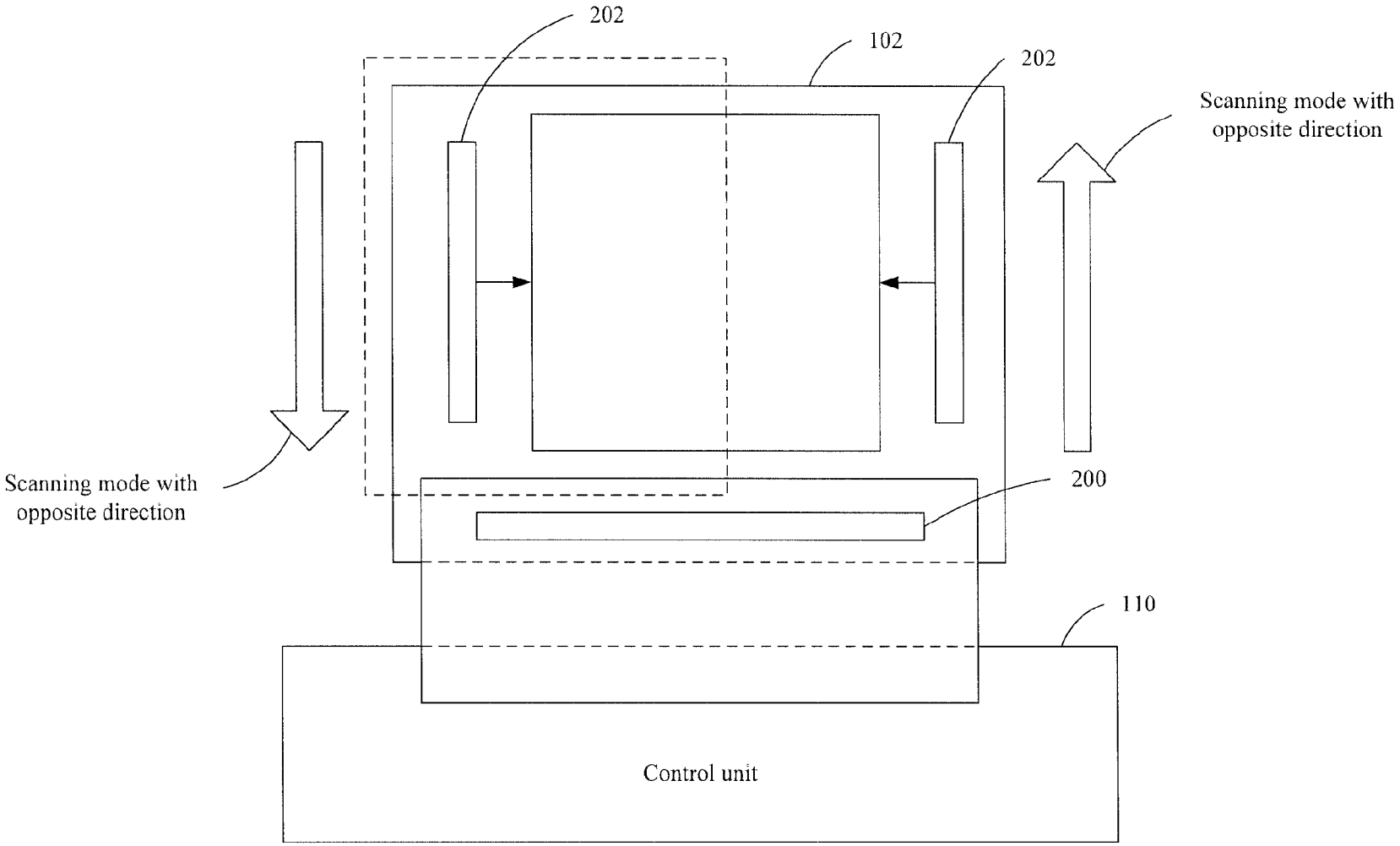
FIG. 2 is a schematic diagram of the scanning module shown in FIG. 1 having opposite scanning direction according to one embodiment of the present invention.

FIG. 2 depicts a schematic diagram of the scanning module shown in FIG. 1 having opposite scanning directions according to one embodiment of the present invention. The control unit 110 controls the source driver 200 to drive the data line of the LCD panel 102 and controls the gate driver 202 to scan the gate lines at two opposite directions. In FIG. 2, the gate driver 202 is disposed at the sides of the LCD panel 102 wherein the gate driver 202 at the left scans the odd gate lines from the top to the bottom and the gate driver 202 at the right scans the even gate lines from the bottom to the top. In another embodiment, the gate driver 202 at the left scans the odd gate lines from the bottom to the top and the gate driver 202 at the right scans the even gate lines from the top to the bottom. It should be noted that the scanning direction at the left and the right can be arranged with the odd gate lines and even lines to generate various arrangements.

In the above description, the scanning direction from top to bottom or vice versa is suitable for each sub-frame in a frame of LCD panel 102, thereby forming an image frame on LCD panel 102. In other words, the scanning direction is switched between the sub-frames of the frame. For example, the scanning direction is switched among sub-frame R, sub-frame G and sub-frame B of the frame.

Figure 3:
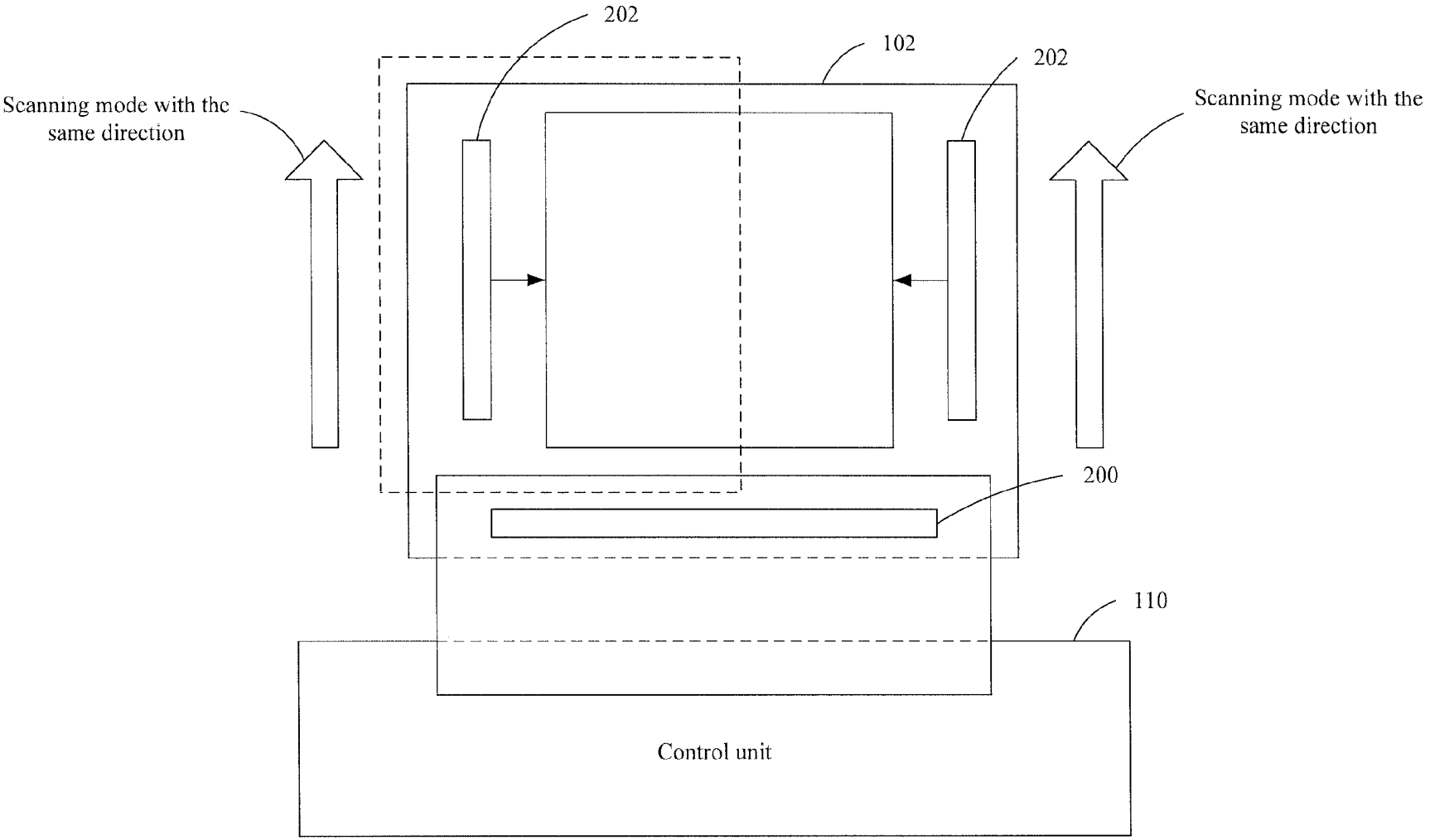
FIG. 3 is a schematic diagram of the scanning module shown in FIG. 1 having the same scanning direction according to one embodiment of the present invention.

FIG. 3 depicts a schematic diagram of the scanning module shown in FIG. 1 having the same scanning direction according to one embodiment of the present invention. The control unit 110 controls the source driver 200 to drive the data line of the LCD panel 102 and controls the gate driver 202 to scan the gate lines at two the same directions. In FIG. 3, the gate driver 202 is disposed at the sides of the LCD panel 102 wherein the gate drivers 202 at the left and the right scans both the odd gate lines and the even gate lines from the top to the bottom or from the bottom to the top. In the above description, the scanning directions at the left and the right from top to bottom or vice versa is suitable for each of sub-frame in a frame of LCD panel 102, thereby forming an image frame on the LCD panel 102.

In view of brightness and temperature, when the data signal is sequentially written into the data lines by opposite scanning directions, the driving system of the present invention can improve the brightness uniformity at the top and bottom region of LCD panel 102 because the opposite scanning provides a balance scanning for LCD panel 102. In comparison with the same scanning direction, even if the brightness in the opposite scanning is a little decrement, however, the decrement percentage is permitted.

When the LCD panel 102 is scanned by opposite scanning direction, the brightness of LCD panel 102 is an inverse proportion to the temperature. For example, at room temperature 25° C. (or another arbitrary temperature), the brightness of LCD panel 102 is 580 nits (cd/m$^2$). At a low temperature, such as 10° C., the brightness is risen to 630 nits. Therefore, since the brightness of LCD panel 102 is increased at a lower temperature, the brightness decrement of LCD panel 102 is compensated when the control unit 110 controls the first switching module 108 to switch to the opposite scanning direction and the brightness is decreased. Thus, the brightness of LCD panel 102 is kept within a stable range. In one embodiment, the time of switching the scanning direction is when the temperature is in a range from 5° C. to 15° C. or in another arbitrary range. Meanwhile, the control unit 110 controls the first switching module 108 to adjust the brightness of LCD panel 102 so that the brightness at the top and bottom regions of panel 102 is uniform.

In view of color saturation (or termed as NTSC percentage) and temperature, when the data signal is sequentially written into the data lines by opposite scanning directions, the color saturation of the LCD panel 102 is slightly decreased when the temperature is decreased. For example, at room temperature 25° C. (or arbitrary temperature), the NTSC percentage of the LCD panel 102 is 98%. At a low temperature, such as 10° C., the NTSC percentage of the LCD panel 102 is 95%. Alternatively, when the data signal is sequentially written into the data lines by the same scanning direction, the color saturation of the LCD panel 102 is decreased when the temperature is decreased. For example, at room temperature 25° C. (or arbitrary temperature), the NTSC percentage of the LCD panel 102 is 90%. In the low temperature, such as 10° C., the NTSC percentage of LCD panel 102 is 50%. Therefore, when the LCD panel 102 is operated at a high temperature, the same scanning direction is employed to scan the gate lines in order to generate preferred brightness performance. When the LCD panel 102 is operated at a low temperature, the opposite scanning direction is employed to scan the gate lines in order to generate preferred color saturation performance. The first switching module 108 of the driving system 100 adjusts the LCD panel 102 to be preferred brightness and color saturation according to various temperatures.

Furthermore, in view of contrast ratio and temperature, when the data signal is sequentially written into the data lines by opposite scanning direction, the contrast ratio of the LCD panel 102 is decreased when the temperature is decreased. For example, at room temperature 25° C. (or arbitrary temperature), the contrast ratio of the LCD panel 102 is 550 nits. At a low temperature, such as 10° C., the contrast ratio of the LCD panel 102 is 450 nits. Alternatively, when the data signal is sequentially written into the data lines by the same scanning direction, the contrast ratio of the LCD panel 102 is also decreased when the temperature is decreased. For example, at room temperature 25° C. (or arbitrary temperature), the contrast ratio of the LCD panel 102 is 200 nits. At a low temperature, such as 10° C., the contrast ratio of the LCD panel 102 is 100 nits.

Therefore, when the LCD panel 102 is operated at a high temperature, the same scanning direction is employed to scan the gate lines in order to generate preferred brightness performance. When the LCD panel 102 is operated at a low temperature, the opposite scanning direction is employed to scan the gate lines in order to generate preferred contrast ratio performance. The first switching module 108 of the driving system 100 adjusts the LCD panel 102 to be preferred brightness and contrast ratio according to various temperatures.

Continuously referring to FIG. 1, the driving system further comprises a driving module 112 and a second switching module 114. The driving module 112 has a plurality of driving modes wherein one of the driving modes corresponds to the sensing signal. The second switching module 114 is electrically coupled to the driving module 112 and switches the driving module for selecting one of the driving modes in response to the sensing signal. The driving modes of driving module 112 includes normal driving mode, synchronous black insertion (SBI) driving mode, and brightness compensation scan (BCS) driving mode, as shown in FIG. 4, FIG. 5 and FIG. 6, respectively.

Figure 4:
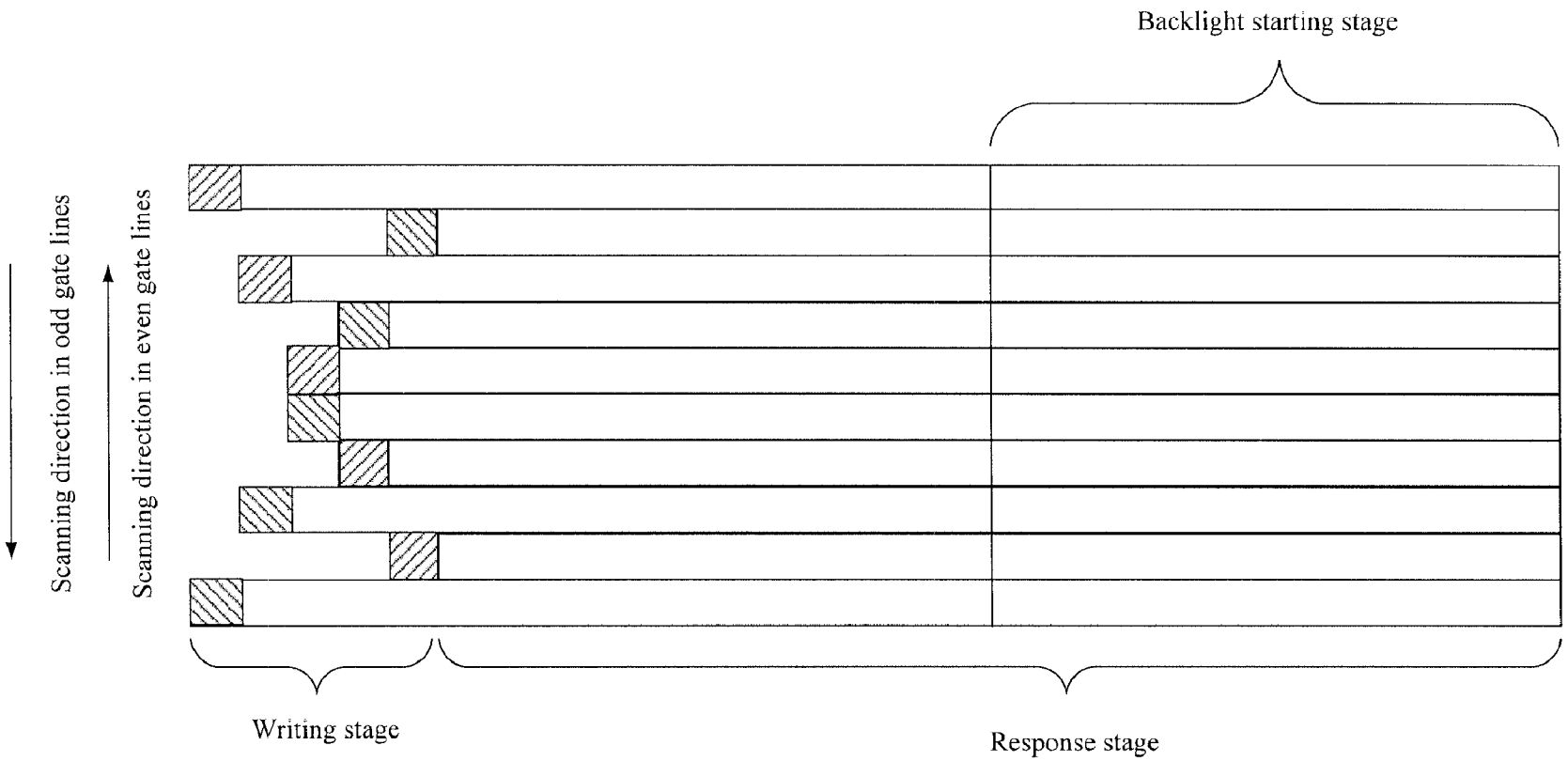
FIG. 4 is a schematic diagram of the driving module shown in FIG. 1 having a first driving mode according to one embodiment of the present invention.

FIG. 4 depicts a schematic diagram of the driving module shown in FIG. 1 having a first driving mode according to one embodiment of the present invention. The first driving mode is normal driving mode. The control unit 110 controls the LCD panel so that gate lines of the LCD panel 102 are scanned by an opposite scanning direction. For example, the odd gate lines are scanned from top to bottom and the even gate lines are inversely scanned from bottom to top. Then, in the writing stage, the gate signals are sequentially written into the gate lines. Afterwards, in the response stage, the liquid crystal of the LCD panel 102 is driven to start to respond to the gate signal. The backlight module is driven during the response of the liquid crystal and illuminates the LCD panel 102 in order to display the sub-frames on the LCD panel 102. Thus, the R, G, and B sub-frames are sequentially displayed to complete a frame. The first driving mode can maintain LCD panel 102 at a higher brightness.

Figure 5:
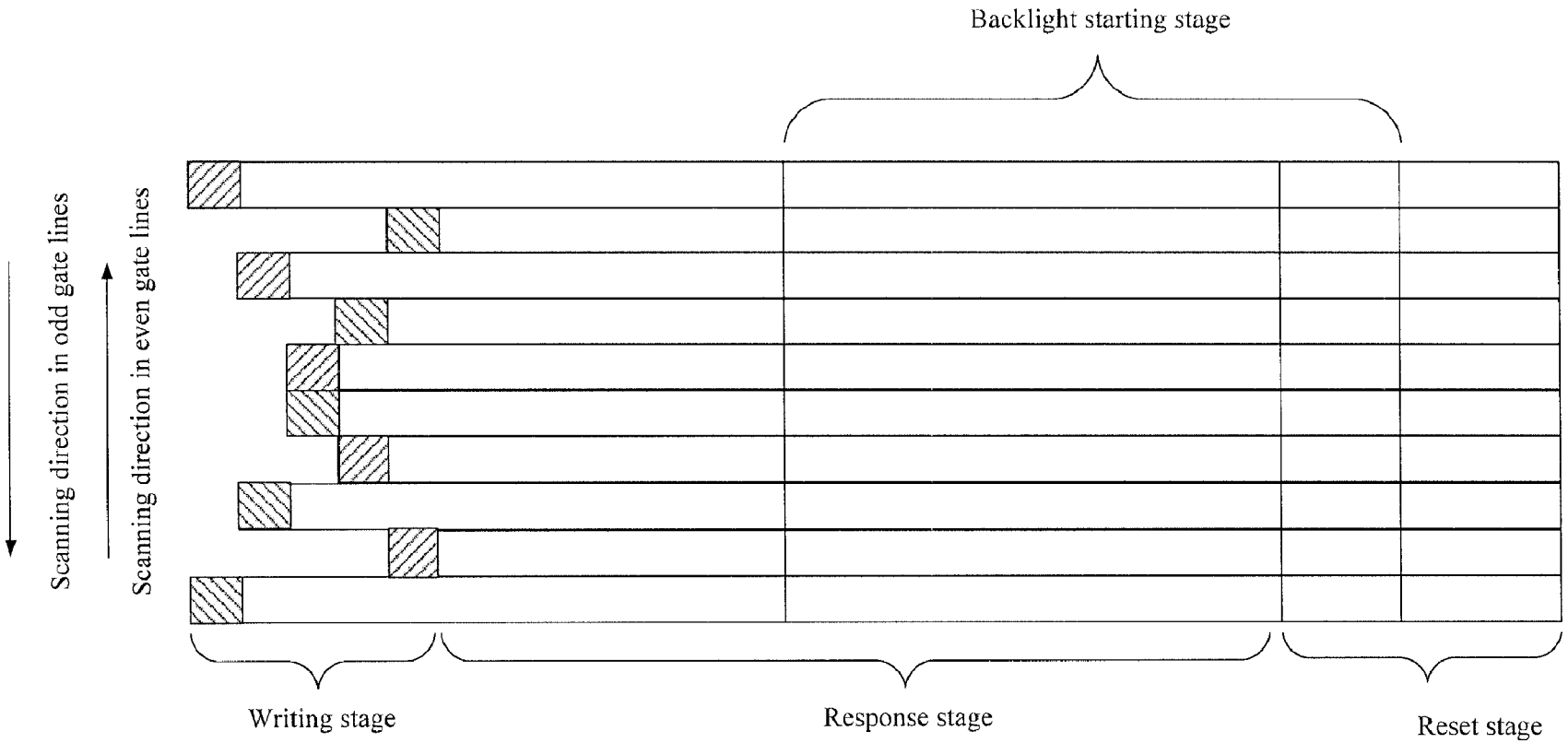
FIG. 5 is a schematic diagram of the driving module shown in FIG. 1 having a second driving mode according to one embodiment of the present invention.

FIG. 5 depicts a schematic diagram of the driving module shown in FIG. 1 having a second driving mode according to one embodiment of the present invention. The second driving mode is a synchronous black insertion (SBI) driving mode. The control unit 110 controls the LCD panel 102 so that gate lines of the LCD panel 102 are scanned by an opposite scanning direction. For example, the odd gate lines are scanned from top to bottom and the even gate lines are inversely scanned from bottom to top. Then, in the writing stage, the gate signals are sequentially written into the gate lines. Afterwards, in the response stage, the liquid crystal of LCD panel 102 is driven to start to respond to the gate signal. The backlight module is driven during the response of the liquid crystal and illuminates LCD panel 102. During the response stage and before the backlight module stops to illuminate LCD panel 102, LCD panel 102 enters a reset stage in order to reset the writing signal and display the sub-frames on the LCD panel 102. Thus, the R, G, and B sub-frames are sequentially displayed to generate a frame. The brightness of LCD panel 102 is slightly decreased but the color saturation is improved during the second driving mode.

Figure 6:
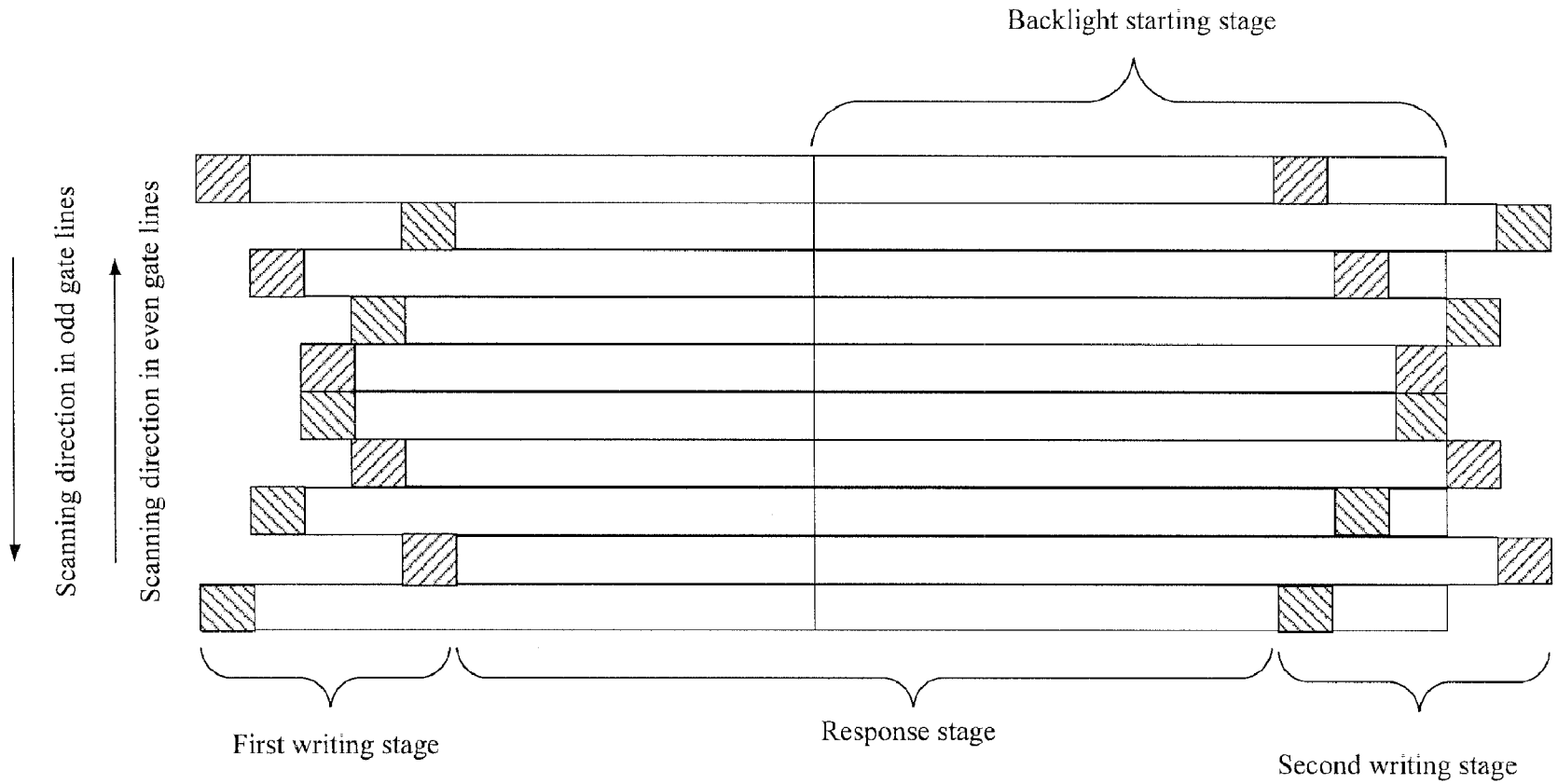
FIG. 6 is a schematic diagram of the driving module shown in FIG. 1 having a third driving mode according to one embodiment of the present invention.

FIG. 6 depicts a schematic diagram of driving module shown in FIG. 1 having a third driving mode according to one embodiment of the present invention. The third driving mode is a brightness compensation scan (BCS) driving mode. The control unit 110 controls the LCD panel 102 so that gate lines of LCD panel 102 are scanned by an opposite scanning direction. For example, the odd gate lines are scanned from top to bottom and the even gate lines are inversely scanned from bottom to top.

Then, in the first writing stage, the gate signals are sequentially written into the gate lines. Afterwards, in the response stage, the liquid crystal of LCD panel 102 is driven to start to respond to the gate signal. The backlight module is driven during the response of the liquid crystal and illuminates LCD panel 102 in order to display the sub-frames on the LCD panel 102. During the response stage and before the backlight module stops to illuminate the LCD panel 102, the LCD panel 102 enters a second writing stage. Basically, the writing sequence in the second writing stage is the same as the writing sequence in the first writing stage. Finally, the R, G, and B sub-frames are sequentially displayed to show a frame. The third driving mode is a sequentially writing mode. The brightness of the LCD panel 102 is slightly decreased but the color saturation and brightness uniformity are improved during the third driving mode.

Based on the above-mentioned experimental results, in the first driving mode, the brightness at the top region, the middle region, and the bottom region are 467 nits, 492 nits, and 473 nits, respectively. The color uniformity is 1.95% and average brightness is 477 nits. In the second driving mode, the brightness at the top region, the middle region, and the bottom region are 447 nits, 480 nits, and 471 nits, respectively. The color uniformity is 0.80% and average brightness is 466 nits. In comparison with the first driving mode, the brightness loss percentage of LCD panel 102 driven by the second driving mode is 1.2%. In the third driving mode, the brightness at the top region, the middle region, and the bottom region are 432 nits, 468 nits, and 451 nits, respectively. The color uniformity is 0.44% and average brightness is 450 nits. In comparison with the first driving mode, the brightness loss percentage of LCD panel 102 driven by the third driving mode is 1.71%.

According to the above descriptions, the average brightness in the first driving mode is greater than that in the second driving mode and the average brightness in the second driving mode is greater than that in the third driving mode. When the LCD panel 102 is operated in first environment having enough brightness, the control unit 110 controls the second switching module 114 to switch the driving module so that LCD panel is operated in the first driving mode. When the LCD panel 102 is operated in a second environment of which brightness is smaller than the brightness of the first environment, the control unit 110 controls the second switching module 114 to switch the driving module so that LCD panel 102 operated in the second driving mode and the color uniformity is improved in comparison with the first driving mode. When the LCD panel 102 is operated in a third environment of which brightness is smaller than the brightness of the second environment, the control unit 110 controls the second switching module 114 to switch the driving module so that LCD panel 102 is operated in the third driving mode and the color uniformity is improved in comparison with the second driving mode. Consequently, according to various environment having brightness requirements, the control unit 110 of the driving system 100 controls the second switching module 114.

Continuously referring to FIG. 1, the driving system further includes a voltage-setting module 116, such as a gamma voltage-setting module, and a third switching module 118. The voltage-setting module 116 has a plurality of voltage-setting values wherein the scanning signal corresponds to one of the voltage-setting values. The third switching module 118 electrically coupled to the voltage-setting module 116 switches the voltage-setting module 116 for selecting one voltage-setting values in response to the sensing signal and driving the gate driver and the data driver of the LCD panel 102.

In one embodiment, the voltage-setting module 116 employs a Gamma voltage having a plurality of voltage levels to drive the data line and the gate lines for generating different brightness. These voltage levels represent a Gamma profile to indicate the relationship between the transmittance and voltage level wherein the Gamma profile is comply with Gamma 2.0, Gamma 2.2, and Gamma 2.0 criteria, or latest criterion in the future. The ratio between the voltage and the brightness is adjusted to be suitable for eyes. When the control unit 110 controls the first switching module 108 and the second switching module 114 to switch to select one driving mode, the third switching module 118 switches the voltage-setting module 116 to select the voltage-setting values for adjusting the ratio between the voltage and the brightness. Thus, the problems of brightness, color saturation, and color-mixing resulting from the temperature are solved. Generally, when the brightness is decreased, the voltage-setting values of the voltage-setting module 116 should be increased to maintain the uniformity of the brightness of the LCD panel 102.

Figure 7:
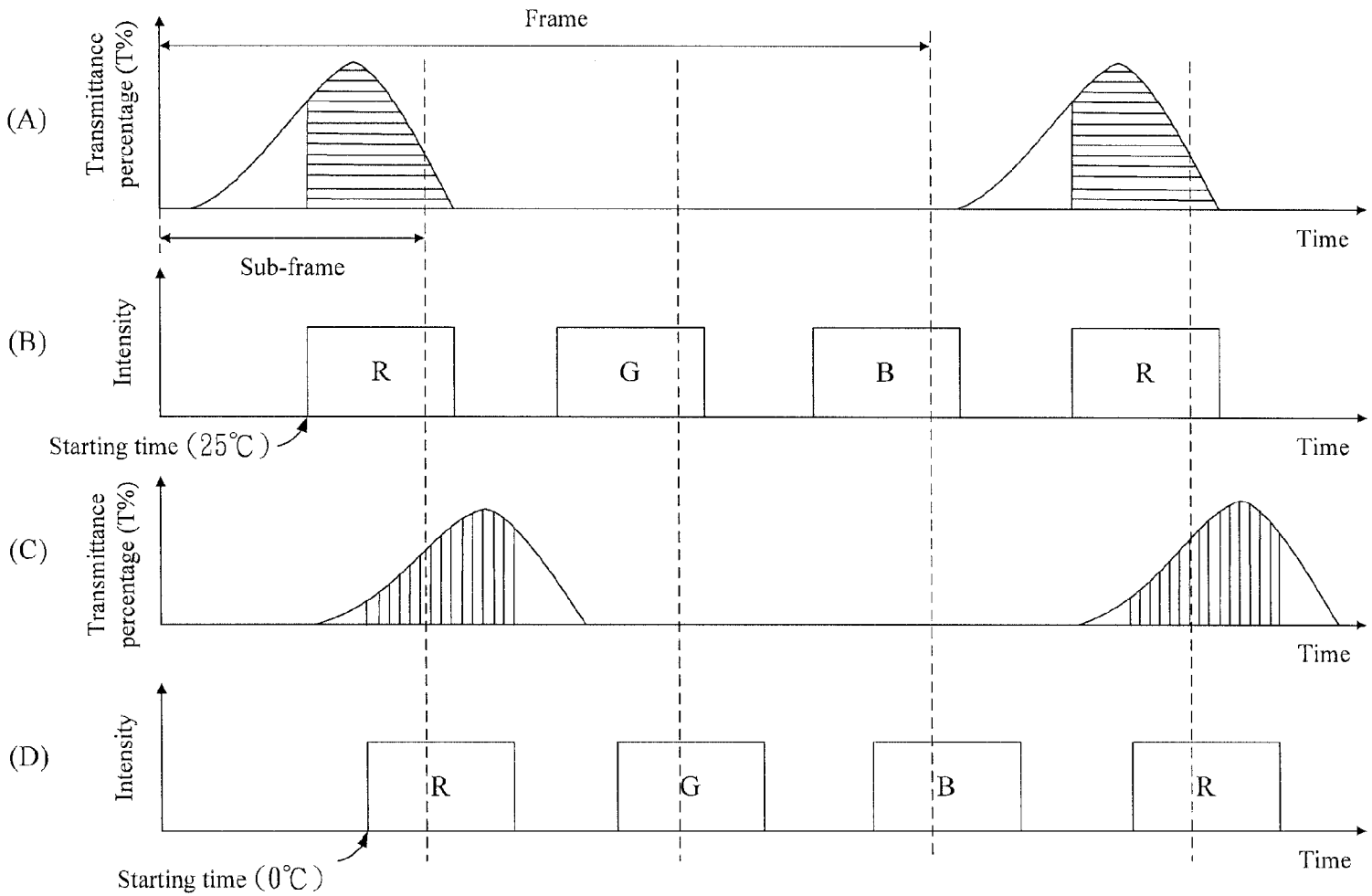
FIG. 7 is a schematic diagram of the backlight-adjusting unit shown in FIG. 1 for controlling the illumination timing of the backlight according to one embodiment of the present invention.

FIG. 7 depicts a schematic diagram of backlight-adjusting unit shown in FIG. 1 for controlling the illumination timing of the backlight, according to one embodiment of the present invention. In FIGS. 7(A) and 7(C), the horizontal axis represents time and vertical axis represents transmittance percentage of liquid crystal, and in FIGS. 7(B) and 7(D), the horizontal axis represents time and vertical axis represents the backlight intensity. In FIG. 7(A), each of the frames is composed of sub-frames R, G, and B. The waveform profile represents the variation relationship between the transmittance percentage and time. For example, the values of sub-frames R, G, and B are termed as (255, 0, 0). In FIG. 7(B), when the LCD panel is operated at temperature 25° C. and the response of the liquid crystal is faster than at a low temperature, e.g. 10° C., the backlight (such as LED) 122 is started in order to illuminate the LCD during the liquid crystal response period in a sub-frame period. The illumination duration of the backlight 122 is within the liquid crystal response period. In FIG. (C), when the LCD panel 102 is operated at a low temperature, e.g. 0° C., the response of the liquid crystal becomes slow and is delayed. In the prior art, the backlight 122 illuminates the LCD panel 102 based on the timing of FIG. (B), color-mixing occurs and downgrades the color saturation of the LCD panel 102. However, as shown in FIG. (D), the backlight-adjusting unit 120 adjusts the backlight 122 so that the starting time of the backlight 122 is delayed with the liquid crystal response. Thus, the illumination duration of the backlight 122 is kept within the liquid crystal response period all the time.

In the present invention, the backlight-adjusting unit 120 and control unit 110 are utilized. The backlight-adjusting unit 120 generates a backlight-timing control value for adjusting the backlight 122 which illuminates the liquid crystal display. The control unit 110 is electrically coupled to the sensor 104 and the backlight-adjusting unit 120 and receives the sensing signal from the sensor 104. The control unit 110 controls the backlight-adjusting unit 120 based on the sensing signal to allow the backlight-adjusting unit 120 to adjust the illumination timing of the backlight 122 according to the backlight-timing control value for changing the brightness of the liquid crystal display.

As a result, the backlight-adjusting unit 120 adjusts the illumination duration of lights R, G, and B based on the sensing signal in response to the temperature so that color saturation of the LCD panel 102 is more uniform. Moreover, during one period of sub-frame, the driving system controls the starting time, illumination duration, end time, and illumination intensity of the lights R, G, and B according to image data. That is, the control unit 110 dynamically controls the timing of on and off of the backlights R, G, and B 122 to improve the color saturation in order to solve the problems of saturation drifts at a low temperature.

Figure 8:
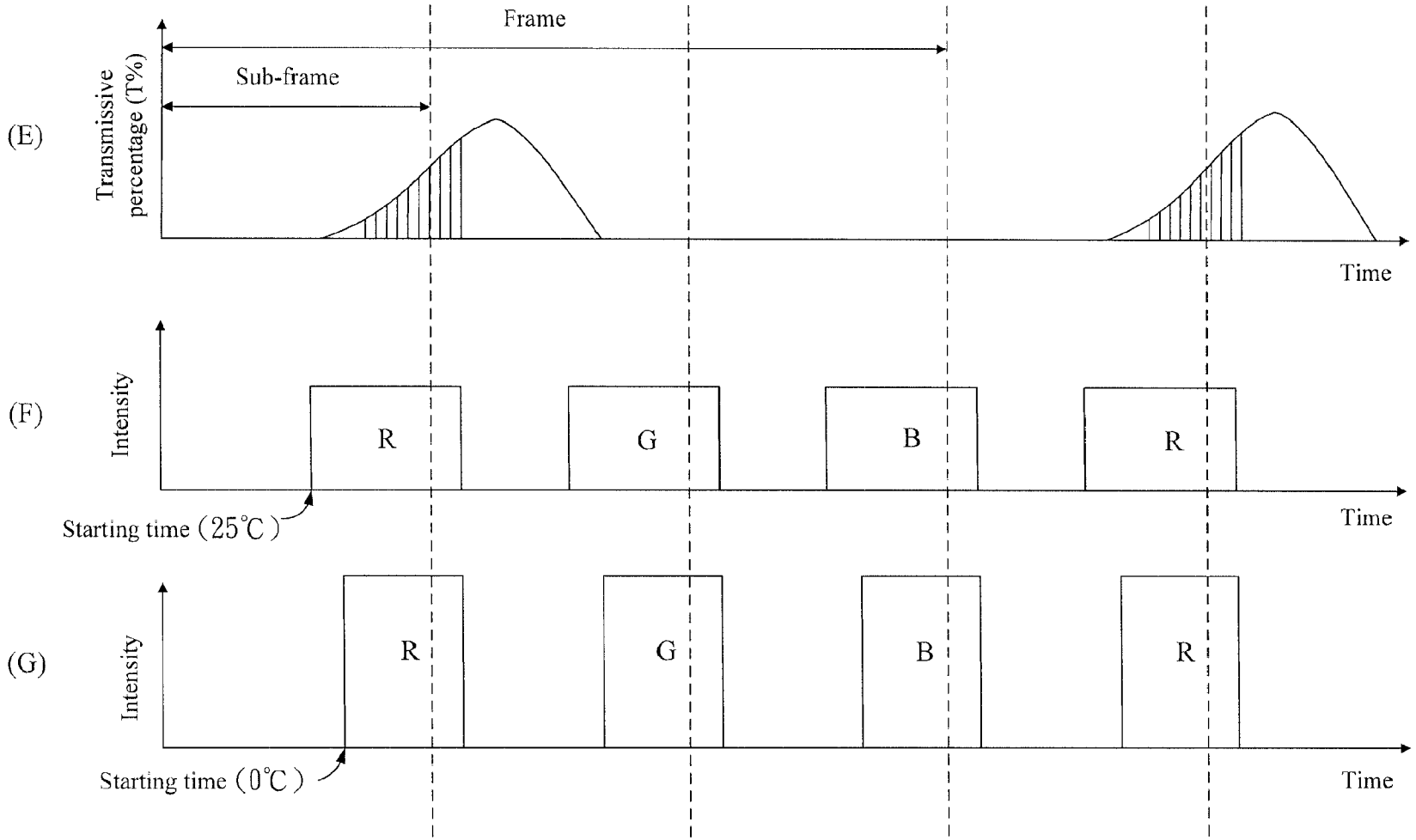
FIG. 8 is a schematic diagram of the backlight-adjusting unit shown in FIG. 1 for controlling the illumination intensity of the backlight according to one embodiment of the present invention.

FIG. 8 depicts a schematic diagram of backlight-adjusting unit 120 shown in FIG. 1 for controlling the illumination intensity of the backlight 122, according to one embodiment of the present invention. FIG. 8(E) is the same as FIG. 7(C) in which the horizontal axis represents time and vertical axis represents transmittance percentage of liquid crystal. In FIGS. 8(F) and 8(G), the horizontal axis represents time and vertical axis represents the backlight intensity. In FIG. 8(F), when the LCD panel is operated at temperature 25° C., the response of the liquid crystal is faster than at a low temperature, e.g. 10° C., and the illumination intensity of the backlight 122 is lower than the illumination intensity shown in FIG. 8(G), the backlight-adjusting unit 120 adjusts the illuminate duration.

In FIG. 8(G), when the LCD panel is operated at a low temperature, e.g. 0° C., the response of the liquid crystal become slow and is delayed. In the prior art, the backlight cannot achieve desired brightness and, however, the illumination intensity of backlight will be increased at a low temperature, resulting in the brightness decrement of the LCD panel. The control unit 110 of the present invention controls the backlight-adjusting unit 120 to decrease the brightness so that the brightness in low temperature is the same as the brightness at a high temperature in view of the same display region. Thus, the power consumption is improved. In one preferred embodiment, the end time of the backlight illumination in FIG. 8(F) is the same as the end time in FIG. 8(G). Further, the backlight-adjusting unit 120 adjust the illumination intensity of backlight 122 so that the brightness in FIG. 8(F) is the same as the brightness in FIG. 8(G). In other words, area R in FIG. 8(F) is identical to area R in FIG. 8(G) to improve the color saturation at a low temperature.

Figure 9:
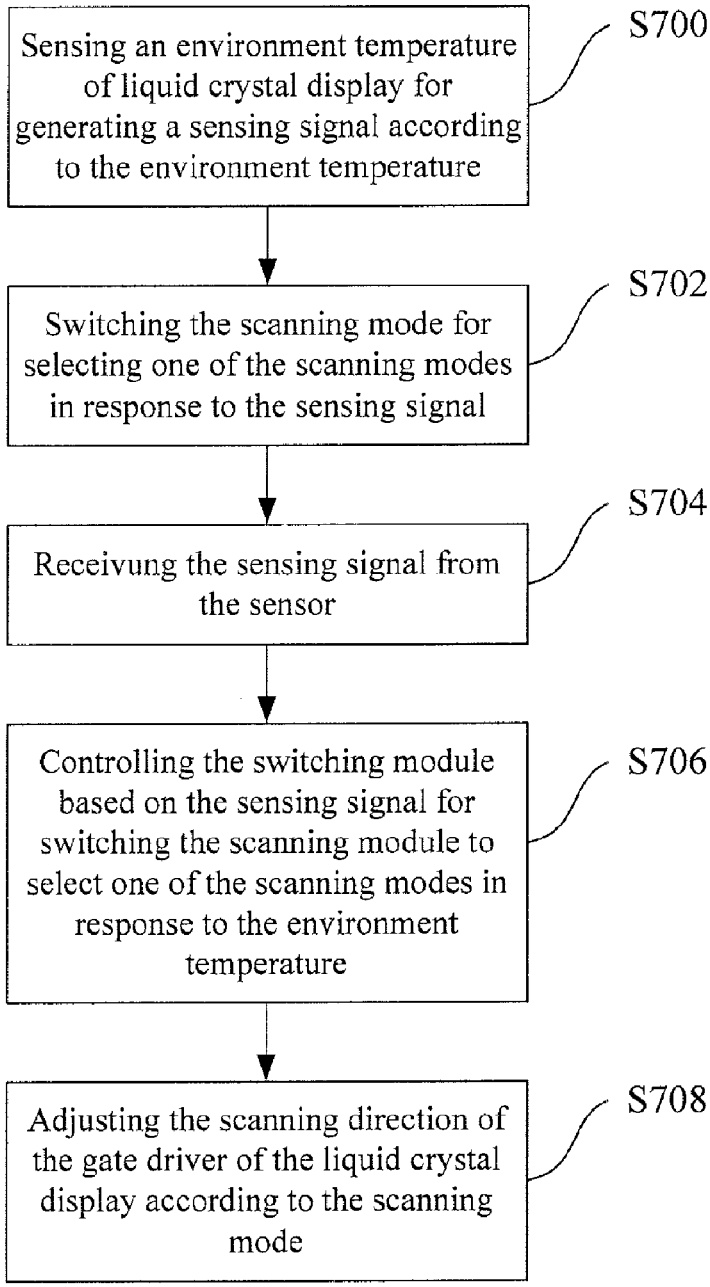
FIG. 9 is a flow chart of a LCD driving method according to one embodiment of the present invention.

FIG. 9 depicts a flow chart of an LCD driving method according to one embodiment of the present invention. The flow chart of the driving method includes the following steps:

In step S700, the sensor 104 senses an environment temperature of a liquid crystal display and generates a sensing signal according to the environment temperature. The sensing signal corresponds to a scanning mode. In one case, the scanning mode can be a status of scanning direction for controlling the gate driver of the liquid crystal display to be the same scanning direction. In another case, the scanning mode may be a status of different scanning directions for controlling the gate driver of the liquid crystal display to be the different scanning directions.

In step S702, the first switching module 108 switches the scanning mode 106 for selecting one of the scanning modes in response to the sensing signal. The scanning module 106 sets the scanning mode 106 to be a status of same scanning direction for controlling the gate driver of the liquid crystal display to be the same scanning direction. Alternatively, the scanning module 106 sets the scanning mode to be a different status of scanning directions for controlling the gate driver of the liquid crystal display to be the different scanning directions.

In step S704, the control unit 110 receives the sensing signal from the sensor 104.

In step S706, the control unit 110 controls the first switching module 108 based on the sensing signal for switching the scanning module to select one of the scanning modes of the scanning module 106 in response to the environment temperature.

In step S708, the control unit 110 adjusts the scanning direction of the gate driver of the liquid crystal display according to the scanning mode.

In one embodiment, the driving method further includes the following steps: A driving module 112 generates a plurality of driving modes wherein one of the driving modes corresponds to the sensing signal. Then, a second switching module 114 switches the driving module for selecting one of the driving modes in response to the sensing signal. The driving modes include a synchronous writing mode and a sequential writing mode.

In another embodiment, the driving method further includes the following steps: A voltage-setting module 116, e.g. gamma voltage-setting module, generates a plurality of voltage-setting values wherein the scanning signal corresponds to one of the voltage-setting values. A third switching module 118 switches the voltage-setting module 116 for selecting one voltage-setting values in response to the sensing signal and drives the gate driver and the data driver of the liquid crystal display.

The present invention provides a driving system and method for color sequential LCD to improve color uniformity and color-mixing when LCD is operated at a low temperature.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A system of color sequential liquid crystal display (LCD), the system comprising:

a sensor for sensing an environment temperature of a liquid crystal display and generating a sensing signal based on the environment temperature;

a scanning module having a plurality of scanning modes wherein one of the scanning modes corresponds to the sensing signal;

a first switching module electrically coupled to the scanning module and adapted to switch the scanning module for selecting one of the scanning modes in response to the sensing signal; and a control unit electrically coupled to the sensor, the first switching module and the liquid crystal display, for receiving the sensing signal and controlling the first switching module based on the sensing signal for switching the scanning module to one of the scanning modes in response to the environment temperature, wherein the control unit adjusts the scanning direction of a gate driver of the liquid crystal display according to the switched scanning mode; and a backlight-adjusting unit electrically coupled to the control unit and adapted to generate a backlight-timing control value for adjusting the backlight which illuminates the liquid crystal display, wherein the backlight is started in order to illuminate the liquid crystal display during a liquid crystal response period and the illumination duration of the backlight is within the liquid crystal response period associated with the backlight-timing control value.

2. The system of claim 1, wherein the scanning module is configured to set the scanning mode to be a status of scanning direction for controlling the gate driver to be the same scanning direction.

3. The system of claim 1, wherein the scanning module is configured to set the scanning mode to be a status of different scanning directions for controlling the gate driver to be the different scanning directions.

4. The system of claim 1, further comprising:

a driving module having a plurality of driving modes, wherein one of the driving modes corresponds to the sensing signal; and a second switching module electrically coupled to the driving module, for switching the driving module for selecting one of the driving modes in response to the sensing signal.

5. The system of claim 4, wherein the driving modes comprises a synchronous writing mode and a sequential writing mode.

6. The system of claim 1, further comprising:

a voltage-setting module having a plurality of voltage-setting values, wherein the scanning signal corresponds to one of the voltage-setting values; and a third switching module electrically coupled to the voltage-setting module and adapted to switch the voltage-setting module for selecting one of the voltage-setting values in response to the sensing signal and driving the gate driver and the data driver of the liquid crystal display.

7. The system of claim 1, wherein the backlight-timing control value is selected from a group consisting of starting time, illumination duration, end time, and illumination intensity.

8. A system of color sequential liquid crystal display (LCD), the system comprising:

a sensor for sensing an environment temperature of a liquid crystal display and generating a sensing signal according to the environment temperature;

a scanning module having a plurality of scanning modes, wherein one of the scanning modes corresponds to the sensing signal;

a first switching module electrically coupled to the scanning module and adapted to switch the scanning module for selecting one of the scanning modes in response to the sensing signal;

a driving module having a plurality of driving modes, wherein one of the driving modes corresponds to the sensing signal;

a second switching module electrically coupled to the driving module and adapted to switch the driving module for selecting one of the driving modes in response to the sensing signal; and a control unit electrically coupled to the sensor, the first switching module, the liquid crystal display and the second switching module, for receiving the sensing signal from the sensor, controlling the first switching module based on the sensing signal for switching the scanning module to select one of the scanning modes in response to the environment temperature, and controlling the second switching module based on the driving mode corresponding to the sensing signal, wherein the control unit adjusts the scanning direction and the driving mode of the liquid crystal display according to the sensing signal; and a backlight-adjusting unit configured to generate a backlight-timing control value for adjusting the illumination timing of the backlight according to the backlight-timing control value for changing the brightness of the liquid crystal display, wherein the backlight is started in order to illuminate the liquid crystal display during a liquid crystal response period and the illumination duration of the backlight is within the liquid crystal response period associated with the backlight-timing control value.

9. The system of claim 8, wherein the scanning module is configured to set the scanning mode as to be status of same scanning direction for controlling the liquid crystal display to be the same scanning direction.

10. The system of claim 8, wherein the scanning module is configured to set the scanning mode to be a status of different scanning directions for controlling the liquid crystal display to be the different scanning directions.

11. The system of claim 8, wherein the driving modes comprises a synchronous writing mode and a sequential writing mode.

12. The system of claim 8, further comprising:

a voltage-setting module having a plurality of voltage-setting values wherein the scanning signal corresponds to one of the voltage-setting values; and a third switching module electrically coupled to the voltage-setting module and adapted to switch the voltage-setting module for selecting one of the voltage-setting values in response to the sensing signal and driving a gate driver and a data driver of the liquid crystal display.

13. A system of color sequential liquid crystal display (LCD), the system comprising:

a sensor for sensing an environment temperature of a liquid crystal display and generating a sensing signal according to the environment temperature;

a backlight-adjusting unit configured to generate a backlight-timing control value for adjusting a backlight which illuminates the liquid crystal display based on the backlight-timing control value and controlling the illumination intensity of the backlight; and a control unit electrically coupled to the sensor and the backlight-adjusting unit, for receiving the sensing signal from the sensor and controlling the backlight-adjusting unit based on the sensing signal to allow the backlight-adjusting unit to adjust the illumination timing of the backlight according to the backlight-timing control value for changing the brightness of the liquid crystal display, wherein the backlight is started in order to illuminate the liquid crystal display during a liquid crystal response period and the illumination duration of the backlight is within the liquid crystal response period associated with the backlight-timing control value.

14. The system of claim 13, wherein the backlight-timing control value is starting time for controlling the illumination beginning of the backlight in a period.

15. The system of claim 13, wherein the backlight-timing control value is illumination duration for controlling the duration of the backlight in a period after the starting time.

16. The system of claim 13, wherein the backlight-timing control value is end time for controlling the illumination termination of the backlight in a period.

17. A method for driving a color sequential liquid crystal display, comprising:

sensing an environment temperature of a liquid crystal display for generating a sensing signal according to the environment temperature, wherein the sensing signal corresponds to a scanning mode;

switching the scanning mode for selecting one of the scanning modes in response to the sensing signal;

receiving the sensing signal from the sensor by a control unit;

controlling a first switching module based on the sensing signal for switching the scanning module to one of a plurality of scanning modes in response to the environment temperature; and adjusting the scanning direction of a gate driver of the liquid crystal display according to the scanning mode; and generating a backlight-timing control value for adjusting a backlight which illuminates the liquid crystal display, wherein the backlight is started in order to illuminate the liquid crystal display during a liquid crystal response period and the illumination duration of the backlight is within the liquid crystal response period associated with the backlight-timing control value.

18. The method of claim 17, wherein the scanning module sets the scanning mode to be a status of scanning direction for controlling the gate driver of the liquid crystal display to be the same scanning direction.

19. The method of claim 17, wherein the scanning module sets the scanning mode to be a status of different scanning directions for controlling the gate driver of the liquid crystal display to be the different scanning directions.

20. The method of claim 17, further comprising:

generating a plurality of driving modes wherein one of the driving modes corresponds to the sensing signal; and switching the driving module for selecting one of the driving modes in response to the sensing signal.

21. The method of a claim 17, wherein the driving modes comprises a synchronous writing mode and a sequential writing mode.

22. The method of according to claim 17, further comprising:

generating a plurality of voltage-setting values wherein the scanning signals corresponds to one of the voltage-setting values; and switching the voltage-setting module for selecting one of the voltage-setting values in response to the sensing signal and driving the gate driver and the data driver of the liquid crystal display.

23. The method of claim 17, wherein the backlight-timing control value is selected from a group consisting of starting time, illumination duration, end time, and illumination intensity.

* * * * *